US005774944A

United States Patent [19]

Choi

[11] Patent Number: 5,774,944

[45] Date of Patent: Jul. 7, 1998

[54] BAND CABLE EASILY RELEASED FROM COUPLING STATE

[76] Inventor: Woncheol Choi, Galak-town 104-306, 1161-2, Handan 2 dong, Shaha-ku Pusan, Rep. of Korea

[21] Appl. No.: 899,327

[22] Filed: Jul. 23, 1997

[30] Foreign Application Priority Data

Jul. 26, 1996 [KR] Rep. of Korea ..... 1996-22686

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 4,490,886 | 1/1985 | Omata | 24/16 PB |
| 4,944,475 | 7/1990 | Ono et al. | 24/16 PB |
| 5,224,244 | 7/1993 | Ikeda et al. | 24/16 PB |
| 5,367,749 | 11/1994 | Takeuchi | 24/16 PB |

*Primary Examiner*—Victor N. Sakran
*Attorney, Agent, or Firm*—Notaro & Michalos P.C.

[57] ABSTRACT

A band cable having a tie through hole which is formed within a head, a stopper which is protrudedly formed on the top surface of the tie through hole, and a tie, on which a plurality of first grooves are formed, which is formed as a unitary body with the head, the band cable including a second groove formed on the lower portion of the tie through hole; and an elastic supporting member whose left and right side surfaces are separated from the inner side surface of the head, thus to move upwardly and downwardly, whereby after the tie is inserted into the tie through hole and is coupled with the head, if the tie coupled with the head is to be released, a user grasps the tie and then presses downwardly it with his thumb, and thereby, as the elastic supporting member is pushed in the downward direction of the second groove, the stopper is easily deviated from the first grooves formed on the tie.

1 Claim, 3 Drawing Sheets

BAND CABLE EASILY RELEASED FROM COUPLING STATE

BACKGROUND OF THE INVENTION

1. Field of the Invention

The present invention relates to a band cable which can be easily released from a coupling state of a tie with a head.

2. Discussion of the Prior Art

Generally, once a tie is coupled with a head in a conventional band cable, the coupled state is not easily released, thus to make the recycling of the band cable impossible. This causes consumption cost of the band cable to be greatly increased. To solve this problem, there is provided a new band cable in which a groove is formed within a head which is placed on the upper portion of a portion on which a stopper is formed, such that the portion on which the stopper is formed is adapted to be upwardly lifted.

That is, if the band table is to be released in the state where the tie is coupled with the head, the portion on which the stopper is formed is lifted up by means of an end of a finger nail of a user's one hand, and at the same time, the tie is separated from the head by means of the other hand of the user.

However, in the case where the finger nail of the user is not appropriate, there occurs an inconvenience in that a sharp and flat tool should be additionally used so as to lift up the portion on which the stopper is formed.

As mentioned above, when the conventional band cable is released from the coupling state of the tie with the head, both hands of the user have to be used. Moreover, since the bottom surface of the portion on which the stopper is formed is elastically in contact with the top surface of the tie, the end of nail or the sharp tool is not well inserted into the bottom surface thereof, thus making it difficult to lift up the portion on which the stopper is formed.

SUMMARY OF THE INVENTION

An object of the present invention is to provide a band cable which can be easily released from a coupling state of a tie with a head, without using both hands of a user or separate tools, in order to be free from the above-mentioned problems.

To achieve this and other objects according to the present invention, there is provided a band cable having a tie through hole which is formed within a head, a stopper which is protrudedly formed on the top surface of the tie through hole, and a tie, on which a plurality of first grooves are formed, which is formed as a unitary body with the head, the band cable including a second groove formed on the lower portion of the tie through hole; and an elastic supporting member whose left and right side surfaces are separated from the inner side surface of the head, thus to move upwardly and downwardly, whereby after the tie is inserted into the tie through hole and is coupled with the head, if the tie coupled with the head is to be released, a user grasps the tie and then presses downwardly it with his thumb, and thereby, as the elastic supporting member is pushed in the downward direction of the second groove, the stopper is easily deviated from the first grooves formed on the tie.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENTS

Hereinafter, an explanation on the construction and operation of the band cable constructed according to the present invention will be in detail discussed with reference to FIGS. 1 to 3.

Figure 1:
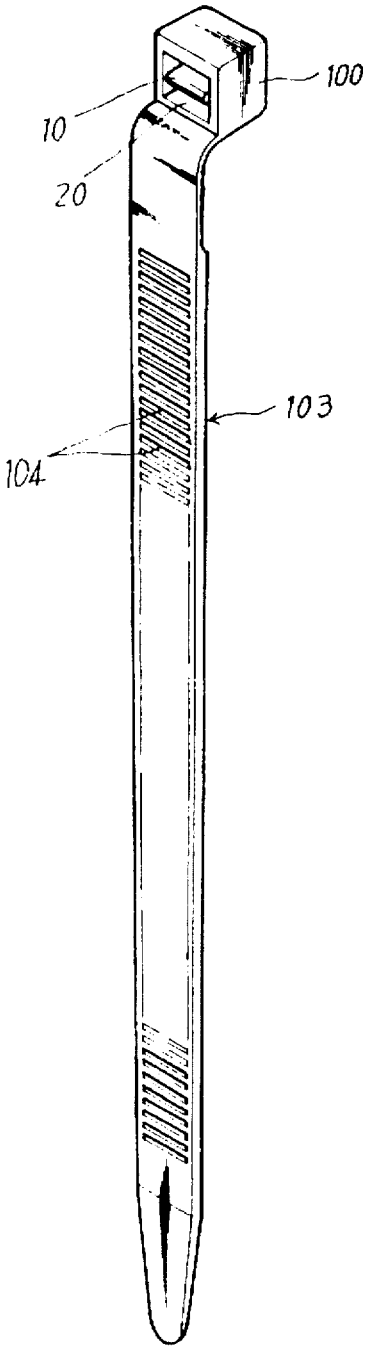
FIG. 1 a perspective view illustrating a band cable constructed according to the present invention.
Figure 2:
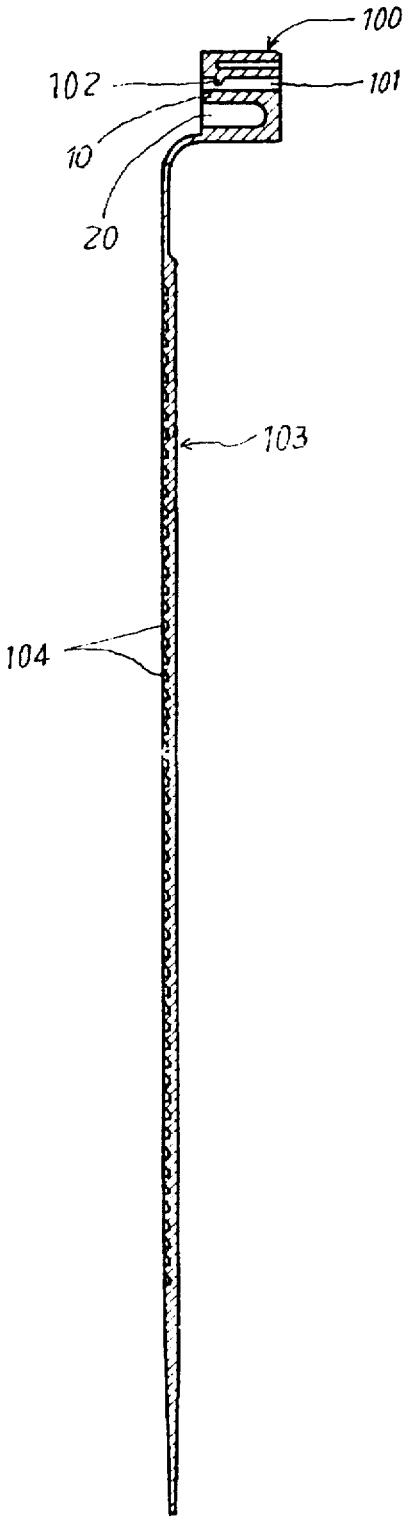
FIG. 2 a sectional view illustrating a band cable constructed according to the present invention.
Figure 3:
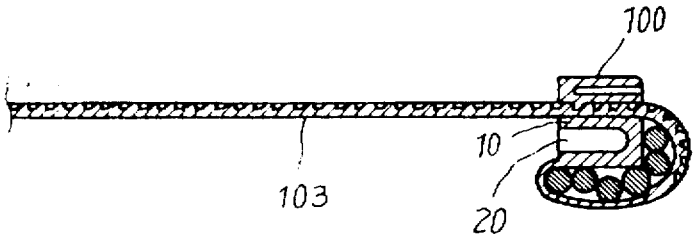
FIG. 3 is a sectional view illustrating a coupling state of a band cable constructed according to the present invention.

Referring to FIGS. 1 to 3, in construction, a band cable according to the present invention, has a tie through hole 101 which is formed within a head 100, a stopper 102 which is protrudedly formed on the top surface of the tie through hole 101, and a tie 103, on which a plurality of first grooves 104 are formed, which is formed as a unitary body with the head 100. Furthermore, the band cable includes a second groove 20 which is formed on the lower portion of the tie through hole 101; and an elastic supporting member 10 whose left and right side surfaces are separated from the inner side surface of the head 100, thus to move upwardly and downwardly, whereby after the tie 103 is inserted into the tie through hole 101 and is coupled with the head 100, if the tie 103 coupled with the head 100 is to be released, a user grasps the tie 103 and then presses downwardly the tie 103 with his thumb), and thereby, as the elastic supporting member 10 is pushed in the downward direction of the second groove 20, the stopper 102 is easily deviated from the first grooves 104 formed on the tie 103.

Figure 4:
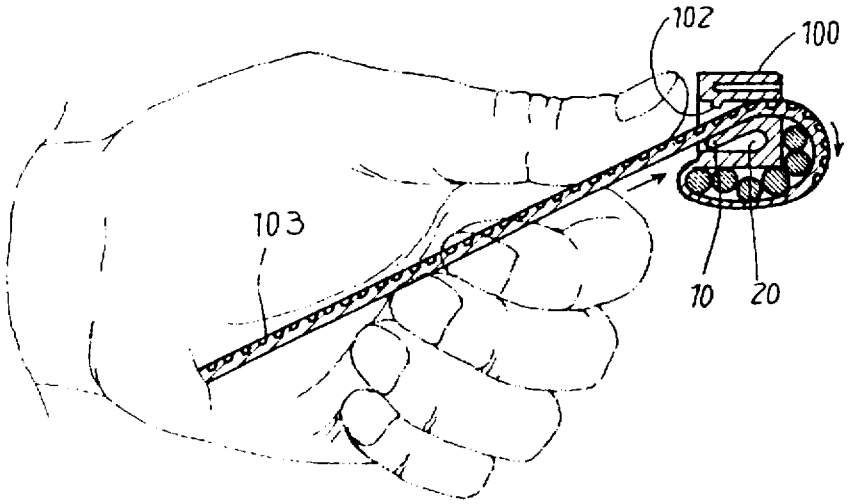
FIGS. 4 and 5 are sectional view respectively illustrating states where the coupling state of a band cable according to the present invention is released.

When the tie 103 is released from the head 100, the tie 103 is grasped by a user's hand, and the upper portion of the tie 103 adjacent to the head 100 is then pressed downwardly by the user's thumb, as shown in FIG. 4. As a result, as the elastic supporting member 10 is descended towards the second groove 20, the stopper 102 is completely separated from the grooves 104 of the tie 103.

At the time, the tie 103 exhibits a restoring force towards the head 100 due to its own elasticity. In this case, if the tie 103 is slightly pushed backwardly at one or more times, the tie 103 is simply separated from the head 100.

During the coupling of the tie 103 with the head 100, the elastic supporting member 10 serves to elastically support the tie 103. Here, since the elastic supporting member 10 has a good quality of elasticity, even though the second groove 20 is formed in the lower portion of the elastic supporting member 10, there is no problem in using the band cable.

Figure 5:
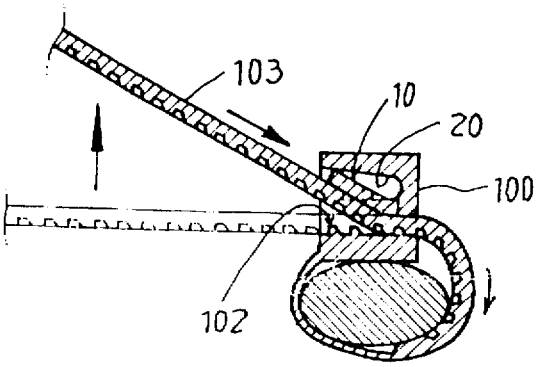

On the other hand, the positions of the second groove 20 and the elastic supporting member 10 are reversed to those of FIG. 4, as shown in FIG. 5, which does not receive any influence on using the band cable.

As apparent from the foregoing, a hand cable constructed according to the present invention can he easily released from a coupling state of a tie with a head, only with one hand of a user.

Although a preferred form of the invention has been described, it will be understood by those skilled in the field that variations therefrom, and analogous uses, are within the knowledge of those skilled in the art. Accordingly, it is intended that the scope of the invention be defined, not by the scope of the foregoing description, but rather by the scope of the claims as interpreted in view of the pertinent prior art.

What is claims is:

1. A band cable having a tie through hole which is formed within a head, a stopper which is protrudedly formed on the top surface of said tie through hole, and a tie, on which a plurality of first grooves are formed, which is formed as a unitary body with said head, said band cable comprising:

a second groove formed on the lower portion of said tie through hole; and an elastic supporting member whose left and right side surfaces are separated from the inner side surface of said head, thus to move upwardly and downwardly, whereby after said tie is inserted into said tie through hole and is coupled with said head, if said tie coupled with said head is to be released, a user grasps said tie and then presses downwardly said tie with his thumb, and thereby, as said elastic supporting member is pushed in the downward direction of said second groove, said stopper is easily deviated from said first grooves formed on said tie.

* * * * *